US010557095B2

(12) United States Patent
Xu et al.

(10) Patent No.: US 10,557,095 B2
(45) Date of Patent: Feb. 11, 2020

(54) GASIFICATION PROCESS AND FEED SYSTEM

(71) Applicant: Air Products and Chemicals, Inc., Allentown, PA (US)

(72) Inventors: Jiang Xu, Beijing (CN); Robert Erwin Van Den Berg, Beijing (CN)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 16/061,563

(22) PCT Filed: Dec. 14, 2015

(86) PCT No.: PCT/CN2015/097253

§ 371 (c)(1),
(2) Date: Jun. 12, 2018

(87) PCT Pub. No.: WO2017/100975

PCT Pub. Date: Jun. 22, 2017

(65) Prior Publication Data

US 2018/0282643 A1 Oct. 4, 2018

(51) Int. Cl.
*C10J 3/82* (2006.01)
*C10J 3/78* (2006.01)
(Continued)

(52) U.S. Cl.
CPC ..... *C10J 3/82* (2013.01); *C10J 3/485* (2013.01); *C10J 3/50* (2013.01); *C10J 3/506* (2013.01);
(Continued)

(58) Field of Classification Search
CPC ..... C10J 3/82; C10J 3/84; C10J 3/78; C10J 3/506; C10J 3/485; C10J 3/50;
(Continued)

(56) References Cited

U.S. PATENT DOCUMENTS 3,018,174 A 1/1962 Steever
3,867,110 A * 2/1975 Schora ..... C10J 3/54 48/210
(Continued)

FOREIGN PATENT DOCUMENTS

CN 101417183 A 4/2009
CN 102060662 A 5/2011
(Continued)

OTHER PUBLICATIONS

Chinese International Search Report and Written Opinion of the International Searching Authority, dated Aug. 26, 2016, for PCT/CN2015/097253.
(Continued)

*Primary Examiner* — Amber R Orlando
*Assistant Examiner* — Syed T Iqbal
(74) *Attorney, Agent, or Firm* — Amy Carr-Trexler

(57) ABSTRACT

A process for the gasification of a solid carbonaceous feed, the process comprising the steps of: introducing a batch of the solid carbonaceous feed into a sluice vessel, while an internal pressure in the sluice vessel is at a first pressure; introducing at least recycled CO2 into the sluice vessel via one or more gas inlets covered by the solid carbonaceous feed, to pressurize the sluice vessel from the first pressure to a second pressure exceeding the first pressure, during a predetermined time period; closing the one or more gas inlets; opening a feed outlet of the sluice vessel to supply the batch of the solid carbonaceous feed to a feed vessel for feeding the solid carbonaceous feed to a gasification reactor; closing the feed outlet; venting the sluice vessel to reduce the internal pressure to the first pressure; and repeating the process.

10 Claims, 3 Drawing Sheets

(51) Int. Cl.

| | |
|---|---|
| ***C10J 3/50*** | (2006.01) |
| ***C10K 3/06*** | (2006.01) |
| ***C10J 3/84*** | (2006.01) |
| ***C10K 1/08*** | (2006.01) |
| ***C10J 3/48*** | (2006.01) |
| ***C10J 3/72*** | (2006.01) |
| ***C10K 1/00*** | (2006.01) |
| ***C10K 1/16*** | (2006.01) |

(52) U.S. Cl.

CPC ..... *C10J 3/723* (2013.01); *C10J 3/726* (2013.01); *C10J 3/78* (2013.01); *C10J 3/84* (2013.01); *C10K 1/005* (2013.01); *C10K 1/08* (2013.01); *C10K 1/16* (2013.01); *C10K 3/06* (2013.01); *C10J 2200/15* (2013.01); *C10J 2200/156* (2013.01); *C10J 2300/093* (2013.01); *C10J 2300/0903* (2013.01); *C10J 2300/0943* (2013.01); *C10J 2300/0969* (2013.01); *C10J 2300/1223* (2013.01); *C10J 2300/1246* (2013.01); *C10J 2300/1659* (2013.01); *C10J 2300/1807* (2013.01); *C10J 2300/1815* (2013.01); *C10J 2300/1846* (2013.01)

(58) Field of Classification Search

CPC .... C10J 3/723; C10J 3/726; C10J 2300/1846; C10J 2300/1659; C10J 2300/1223; C10J 2300/0943; C10J 2300/093; C10J 2300/0903; C10J 2200/15; C10J 2300/1807; C10J 2200/156; C10J 2300/1815; C10J 2300/0969; C10J 2300/1246; C10K 3/06; C10K 1/08; C10K 1/16; C10K 1/005

See application file for complete search history.

(56) References Cited

U.S. PATENT DOCUMENTS

| | | | | |
|---|---|---|---|---|
| 4,017,271 | A | 4/1977 | Barclay et al. | |
| 4,515,604 | A | 5/1985 | Eisenlohr et al. | |
| 2007/0225382 | A1* | 9/2007 | Van Den Berg ..... | C10J 3/485 518/702 |
| 2008/0056971 | A1 | 3/2008 | Hughes | |
| 2012/0111416 | A1 | 5/2012 | Kowoll | |
| 2012/0182827 | A1 | 7/2012 | Bairamijamal | |

FOREIGN PATENT DOCUMENTS

| | | | |
|---|---|---|---|
| CN | 102517086 | A | 6/2012 |
| KR | 2011-0118143 | A | 10/2011 |

OTHER PUBLICATIONS

Korean Office Action; dated Jun. 19, 2019, 5 pgs.

* cited by examiner

GASIFICATION PROCESS AND FEED SYSTEM

BACKGROUND OF THE INVENTION

The present disclosure relates to a gasification process and feed system for the production of synthesis gas by partial combustion of a carbonaceous feed. The disclosure is directed to a feed process and system for supplying the carbonaceous feed to a gasification reactor.

The carbonaceous feed can for instance comprise pulverized coal, biomass, petcoke, or any other type of solid carbonaceous feed or mixture thereof. In particular the carbonaceous feed is supplied as a solid dry feedstock.

Typically, the carbonaceous feed is provided to one or more burners of a gasification reactor, together with an oxygen comprising gas stream and optionally also a moderator gas. In the reactor, the feed is partially oxidized to provide syngas. The syngas is subsequently cooled in a quench section. The cooled syngas is typically treated, for instance to remove contaminants.

Syngas, or synthesis gas, as used herein is a gas mixture comprising hydrogen and carbon monoxide, and some carbon dioxide. The (treated) syngas can be used, for instance, as a fuel, or as an intermediary product for creating synthetic natural gas (SNG) or for producing ammonia, methanol, hydrogen, waxes, synthetic hydrocarbon fuels or oil products, or as a feedstock for other chemical processes.

US2007225382 discloses a process to produce synthesis gas or a hydrocarbon product from a solid carbonaceous fuel in a gasification reactor. The carbonaceous fuel and an oxygen containing stream are supplied to a burner of a gasification reactor, wherein a CO2-containing transport gas is used to transport the solid carbonaceous fuel to the burner. The carbonaceous fuel is partially oxidized in the gasification reactor, to obtain synthesis gas. The synthesis gas can be further processed in a downstream process path, to convert the syngas into a selected hydrocarbon product. The downstream process path may contain a methanol-synthesis reactor to produce the hydrocarbon product, such as methanol. The downstream process path may contain a Fischer-Tropsch synthesis reactor to convert the syngas and allow to produce a selected product from a range of hydrocarbon products.

The environmental regulations governing the emission vent gases from a (coal) gasification plant are becoming ever more strict. One recent issue has arisen for so-called dry-coal feed systems, which use CO2 as an inert gas for coal pressurisation and feeding, such as for instance disclosed in US2007225382. After coal transport into the gasifier, the excess gas used for pressurisation in the so-called lock hopper, sluice hopper, or sluice vessel is vented, after which a new pressurisation cycle starts. The CO2 that is used in this process may be derived from a Rectisol syngas treating plant, which typically uses methanol as an absorbent for CO2 and/or H2S, to remove the latter from the syngas. Consequently, the recycled CO2 may contain methanol up to a concentration which exceeds allowable vent levels, for instance in the order of 300 to 400 ppm (volume).

There are currently hardly any acceptable alternative technologies, since absorbers of methanol rely on water, which then gets absorbed in the CO2 to levels which are unacceptable for dry-feeding of coal. In addition, such absorbers would increase the cost of a coal gasification plant.

BRIEF DESCRIPTION OF THE INVENTION

It is an object of the disclosure to provide an improved gasification system and method, obviating at least one of the problems described above.

The invention provides a process for the gasification of a solid carbonaceous feed, the process comprising the steps of:

introducing a batch of the solid carbonaceous feed into a sluice vessel, while an internal pressure in the sluice vessel is at a first pressure;

introducing at least recycled CO2 into the sluice vessel via one or more gas inlets covered by the solid carbonaceous feed, to pressurize the sluice vessel from the first pressure to a second pressure exceeding the first pressure, during a predetermined time period;

closing the one or more gas inlets;

opening a feed outlet of the sluice vessel to supply the batch of the solid carbonaceous feed to a feed vessel for feeding the solid carbonaceous feed to a gasification reactor;

closing the feed outlet;

venting the sluice vessel to reduce the internal pressure to the first pressure; and repeating the process.

In an embodiment, the disclosure provides a gasification system, the recycled CO2 is introduced into the sluice vessel at a relatively low flow rate. The reduced flow rate may be about 0.5 times or less than a regular flow rate of pressurizing gas. The recycled CO2 is being introduced into the sluice vessel at a relatively low flow rate. The reduced flow rate improves the absorbtion of methanol in the CO2 stream by the batch of feedstock, typically coal powder, in the sluice vessel. At significantly reduced rates of about 0.5 times normal flow rates or less, absorption is optimal.

In an embodiment, the second pressure exceeds 40 bar. The predetermined time period for pressurizing the sluice vessel may be at least 10 minutes.

The recycled CO2 can be derived from a Rectisol syngas treating process which uses methanol as an absorbent. Herein, the recycled CO2 may comprise methanol up to a concentration which exceeds allowable vent levels. The recycled CO2 may comprise methanol in a concentration of at least 300 to 400 ppm (volume).

In an embodiment, the process comprises the step of keeping the sluice vessel at an elevated temperature and elevated second pressure during a second time period. The elevated temperature helps to keep the batch of feedstock fluidized, even in combination with reduced flow rates of introduced CO2. In combination with reduced flow rates, the elevated temperature and pressure assist to further improve absorption and reduce the methanol content before venting, while allowing a properly fluidized bed of feedstock.

According to another aspect, the disclosure provides a feed system for a gasification process as described above.

BRIEF DESCRIPTION OF THE DRAWINGS

These and other features, aspects, and advantages of the present disclosure will be apparent from the following detailed description with reference to the accompanying drawings in which like characters represent like parts throughout the drawings, and wherein.

DETAILED DESCRIPTION OF THE INVENTION

The invention is illustrated with reference to a coal-to-methanol system and process as a particular example of a general carbonaceous fuel to organic substance system and process.

Figure 1:
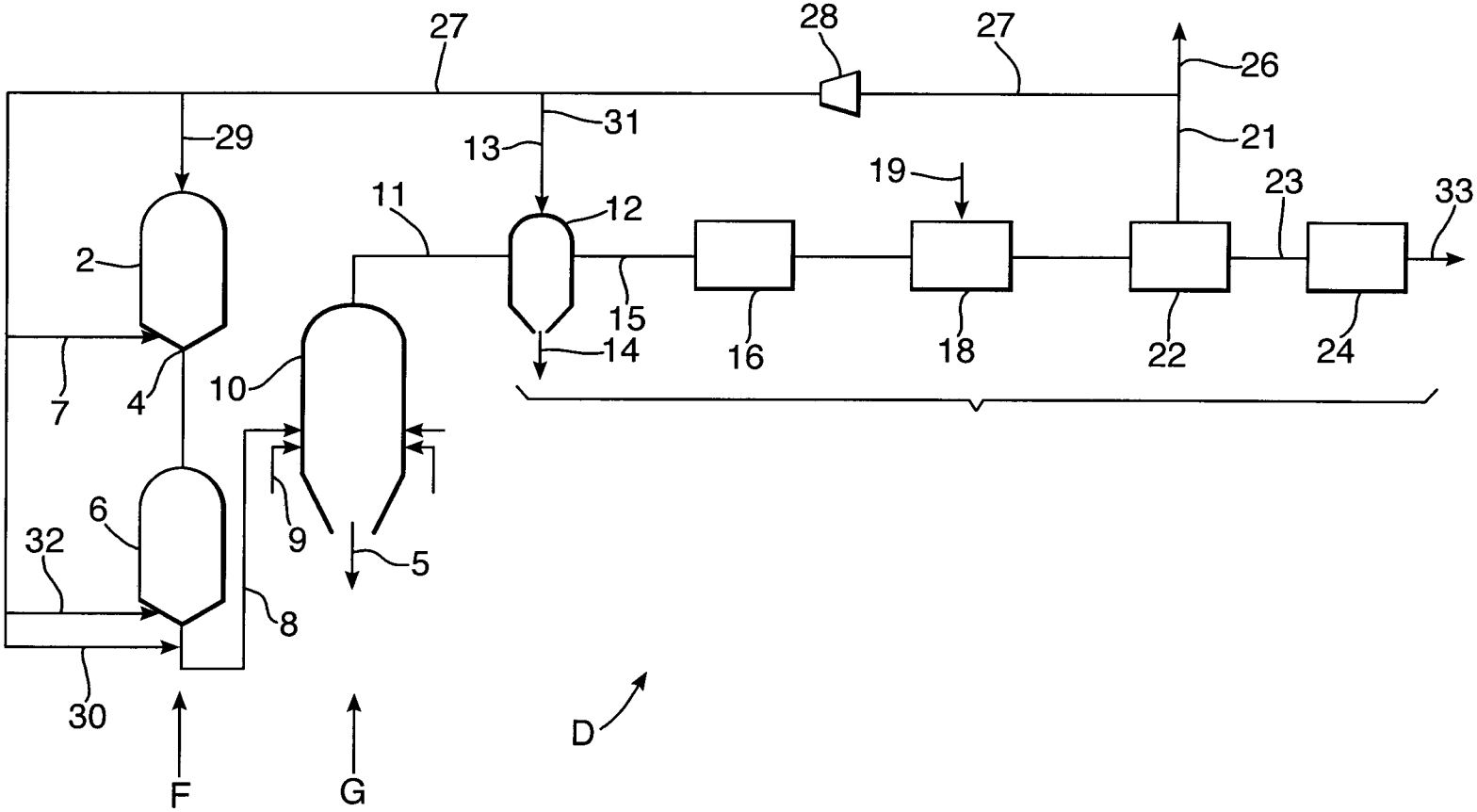
FIG. 1 shows a process scheme of an exemplary coal-to-methanol synthesis system.

FIG. 1 schematically shows a process block scheme of a coal-to-methanol synthesis system. For simplicity, valves and other auxiliary features are not shown. The coal-to-methanol synthesis system may comprise a carbonaceous fuel supply system (F); a gasification system (G) to produce a gaseous stream of an intermediate product containing synthesis gas; and an optional downstream system (D) for further processing of the intermediate product into a selected organic substance, such as methanol. A process path extends through the fuel supply system F and via the gasification system G to the downstream system D.

In the exemplary system, the fuel supply system F comprises a sluicing vessel or lockhopper 2 and a feed hopper 6. The gasification system G comprises a gasification reactor 10. The fuel supply system is arranged to pass the carbonaceous fuel along the process path into the gasification reactor 10. The downstream system D may comprise an optional dry-solids removal unit 12, an optional wet scrubber 16, an optional shift conversion reactor 18, a CO2 recovery system 22, and a methanol synthesis reactor 24 for a methanol-forming reaction.

The lockhopper 2 is provided for sluicing a dry, solid carbonaceous fuel, typically in the form of fine particulates of coal, from a first pressure region to a second pressure region. A first pressure in the first pressure region is typically a pressure at which the fuel is stored. Typically, the first pressure is atmospheric pressure, about 1 atmosphere. A second pressure in the second pressure region typically exceeds the first pressure, and is a pressure at which the fuel is transported into the gasification reactor. The second pressure typically exceeds the operating pressure within the gasification reactor. The second region may be the interior of the feed hopper 6.

The operating pressure inside the gasification reactor may exceed 10 atmosphere. The operating pressure may be between 10 and 90 atmosphere, preferably between 10 and 70 atmosphere, typically between 30 and 60 atmosphere.

The term fine particulates is intended to include at least pulverized particulates having a particle size distribution so that at least about 90% by weight of the material has a diameter of 90 μm or less. Moisture content is typically between 2 and 12% by weight, and preferably less than about 5% by weight.

The sluicing vessel or lockhopper 2 may discharge b batches of fuel into the feed hopper 6 via a discharge opening 4. The feed hopper ensures a continuous feed rate of the fuel to the gasification reactor 10. The discharge opening 4 is preferably provided in a discharge cone, which in the embodiment of FIG. 1 is provided with an aeration system 7 for aerating the dry solid content of the sluicing vessel 2.

The feed hopper 6 is arranged to discharge the fuel via conveyor line 8 to one or more burners provided in the gasification reactor 10. The gasification reactor 10 may have burners in diametrically opposing positions, and/or a burner at the top of the reactor.

Line 9 connects the one or more burners to a supply of an oxygen containing stream (for instance substantially pure O2, comprising more than 90% or 95% O2, or air). The burner is preferably a co-annular burner with a passage for an oxygen containing gas and a passage for the fuel and the transport gas. The oxygen containing gas preferably comprises at least 90% by volume oxygen. Nitrogen, carbon dioxide and argon being permissible as impurities. Substantially pure oxygen is preferred, such as prepared by an air separation unit (ASU). Steam may be present in the oxygen containing gas as it passes the passage of the burner. A mixture of the fuel and oxygen from the oxygen-containing stream reacts in a reaction zone in the gasification reactor 10.

A reaction between the carbonaceous fuel and the oxygen-containing fluid takes place in the gasification reactor 10, producing a gaseous stream of synthesis gas containing at least CO and H2. Generation of synthesis gas occurs by partially combusting the carbonaceous fuel at a relatively high temperature, for instance in the range of 1000° C. to 3000° C. and at a pressure in a range of about 1 to 70 bar. Slag and other solids may be discharged from the gasification reactor via line 5, after which they can be further processed for disposal.

The feed hopper 6 preferably has multiple feed hopper discharge outlets, each outlet being in communication with at least one burner associated with the reactor. Typically, the pressure inside the feed hopper 6 exceeds the pressure inside the reactor 9, in order to facilitate injection of the powder coal into the reactor.

The gaseous stream of synthesis gas leaves the gasification reactor 10, for instance through line 11 at the top. Subsequently the syngas is cooled. A syngas cooler (not shown) may be provided downstream of the gasification reactor 10 to have some or most of the heat recovered for the generation of, for instance, high-pressure steam.

Finally, the synthesis gas enters the downstream system D in a downstream path section of the process path, wherein the dry-solids removal unit 12 is optionally arranged.

The dry-solids removal unit 12 may be of any type, including the cyclone type. The ash removal unit 12 may be a ceramic candle filter unit, such as described in EP-551951. Line 13 is in fluid communication with a ceramic candle filter unit to provide a blow back gas pressure pulse at timed intervals in order to blow back dry solid material that has accumulated on the ceramic candles away from the ceramic candles. The dry solid material is discharged from the dry-solids removal unit via line 14 from where it is further processed prior to disposal.

The filtered gaseous stream 15, now substantially free from dry solids, may progress along the downstream path section of the process path through the downstream system, and may be provided, optionally via wet scrubber 16 and optional shift conversion reactor 18, to the CO2-recovery system 22.

The CO2-recovery system 22 functions by dividing the gaseous stream into a CO2-rich stream and a CO2 poor stream (the latter being rich in CO and H2). The CO2-recovery system 22 typically has an outlet 21 for discharging the CO2-rich stream and an outlet 23 for discharging the CO2-poor stream in the process path. Outlet 23 may be in communication with the methanol synthesis reactor 24, where the discharged CO2 poor stream, which is rich in CO and H2, can be subjected to the methanol-forming reaction.

The synthesis gas 10 discharged from the gasification reactor may comprise at least H2 and CO, and typically also some CO2. The suitability of the synthesis gas composition for the methanol forming reaction is expressed as the stoichiometric number SN of the synthesis gas, whereby expressed in the molar contents [H2], [CO], and [CO2], SN=([H2]−[CO2])/([CO]+[CO2]). It has been found that the stoichiometric number of the synthesis gas produced by gasification of the carbonaceous feed is lower than the desired ratio of about 2.03 for forming methanol in the methanol synthesis reactor 24. By performing a water shift reaction in shift conversion reactor 18 and separating part of the carbon dioxide in CO2-recovery system 22 the SN number can be adjusted. Preferably hydrogen separated from the methanol synthesis off gas can be added to the synthesis gas to further increase the SN (not shown in Figure).

Any type of CO2-recovery may be employed, but absorption based CO2-recovery is preferred, such as physical or chemical washes, because such recovery also removes sulphur-containing components such as H2S from the process path.

The CO2-rich stream becomes available for a variety of uses to assist the process, of which examples will now be discussed.

A feedback line 27 may be provided to bring a feedback gas from the downstream system D to feedback inlets providing access to one or more other points in the process path that lie upstream of the outlet 21, suitably via one or more of branch lines 7, 29, 30, 31, 32 each being in communication with line 27.

The process scheme of FIG. 1 obviates a separate source of compressed gas for bringing additional gas into the process path. Nitrogen may also be used as the carrier gas for bringing the fuel to and into the gasification reactor 10, as the blow-back gas in the dry solids removal unit 12, or as purge gas or aeration gas in other places. However, using nitrogen may introduce unwanted inert components into the process path, which may adversely affect, for instance, the methanol synthesis efficiency. CO2 is available from the gaseous product stream anyway, so recycling at least some of the CO2 is advantageous both economically and for process efficiency.

One or more feedback gas inlets are preferably provided in the fuel supply system such that in operation a mixture comprising the carbonaceous fuel and the feedback gas is formed. Herewith, an entrained flow of the carbonaceous fuel with a carrier gas comprising the feedback gas can be formed in conveyor line 8 to feed the gasification reactor 10. Examples are indicated in FIG. 1. Herein, branch lines 7 and 29 discharge into the lockhopper 2 for pressurising and/or aerating its content. Branch line 32 discharges into the feed hopper 6 to optionally aerate its content, and branch line 30 feeds the feedback gas into the conveyor line 8 for transporting the feedstock to the reactor.

The feedback gas is preferably brought into the process path through one or more sintered metal pads, which can for instance be mounted in the conical section of sluicing vessel or lockhopper 2. In the case of conveyor line 8, the feedback gas may be directly injected.

The CO2-recovery system 22 may alternatively be located downstream of the hydrocarbon synthesis reactor 24, since a significant fraction of the CO2 will generally not be converted into the organic substance to be synthesised. However, an advantage of an upstream location relative to the methanol synthesis reactor 24 is that the CO- and H2-rich stream forms an improved starting mixture for a subsequent methanol synthesis reaction, because it has an increased stoichiometric ratio. The stoichiometric ratio is defined as ([H2] [CO2])/([CO]+[CO2]). Preferably, the optimal stoichiometric ration is about 2.03 for the synthesis of methanol.

In the embodiment of FIG. 1, an optional shift conversion reactor 18 is disposed in the process path upstream of the CO2-recovery system 22. The shift conversion reactor is arranged to convert CO and Steam into H2 and CO2. Steam can be fed into the shift conversion reactor via line 19. An advantage hereof is that the amount of H2 in the gaseous mixture is increased so that the stoichiometric ratio is further increased. The CO2 as formed in this reaction may be advantageously used as transport gas in step (a).

Naturally, the methanol that is discharged from the methanol synthesis reactor 24 along line 33 may be further processed to meet desired requirements, for instance including purification steps that may include for instance distillation, or even including conversion steps to produce other liquids such as for instance one or more of the group including gasoline, dimethyl ether (DME), ethylene, propylene, butylenes, isobutene and liquefied petroleum gas (LPG).

The feedback inlets may be connected to an external gas supply, for instance for feeding CO2 or N2 or another suitable gas during a start-up phase of the process. When a sufficient amount of syngas—and accordingly a sufficient amount of CO2—is being produced, the feedback inlet may then be connected to the outlet for the CO2 containing feedback gas, originating from the produced CO2-rich stream. Nitrogen may be used as external gas for start-up of the process. In start-up situations no carbon dioxide will be readily available. When the amount of carbon dioxide as recovered from the gaseous stream is sufficient, the amount of nitrogen can be reduced to zero.

Figure 2:
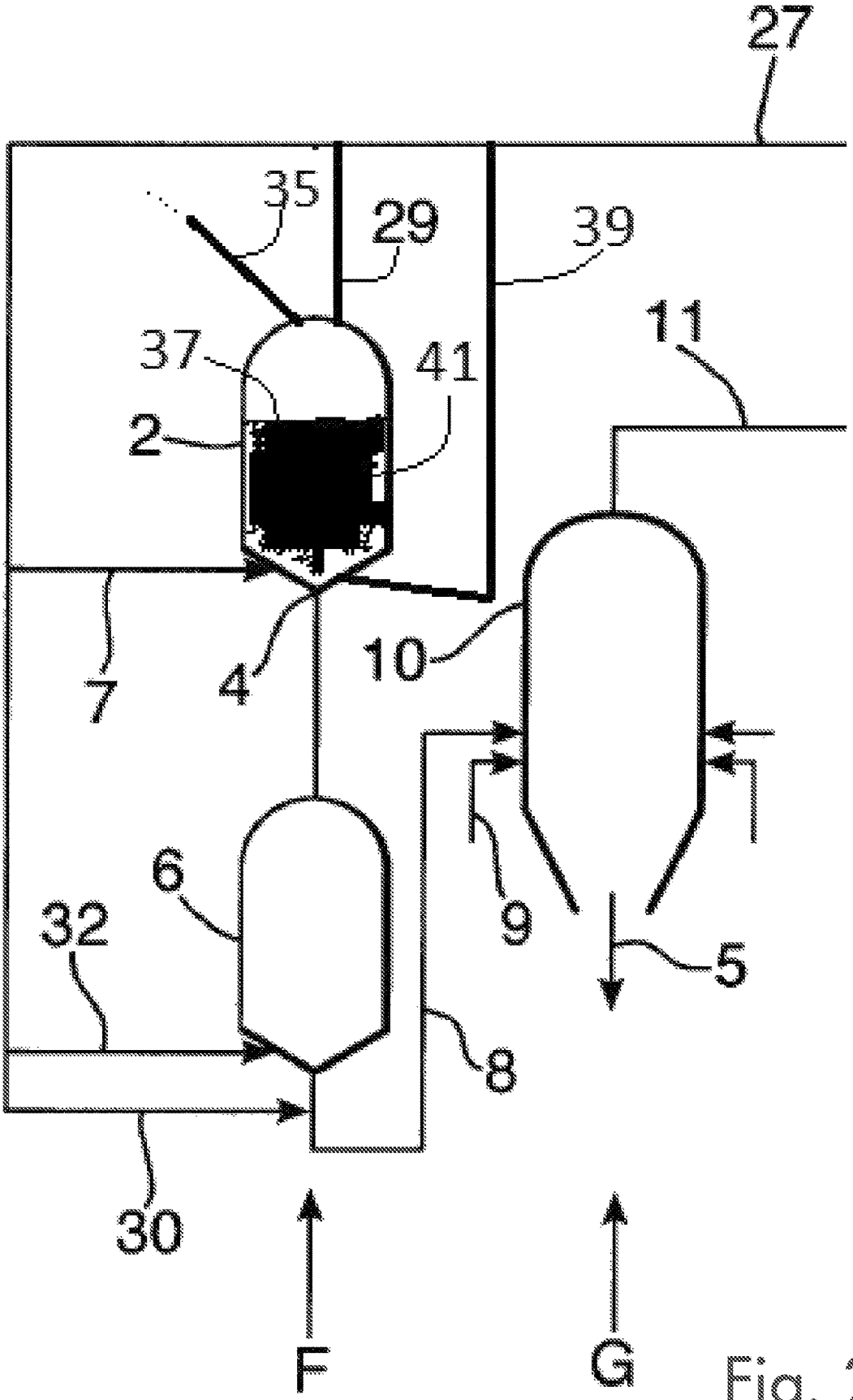
FIG. 2 shows a detail of an improved feedback system according to the disclosure.

FIG. 2 shows the lockhopper or sluice vessel 2, provided with a batch of coal powder 41. An optional additional inlet line 39 may be provided, connected to a gas inlet at or near a lower end 4 of the sluice vessel 2. A top end of the vessel 2 is provided with a gas vent line 35 for venting gas from the vessel. The vent line 35, and inlet lines 7, 29, 39 are all provided with appropriate gas valves (not shown) to allow gas out or in respectively. The valves may be one-way valves to prevent the feedstock, such as pulverized coal, from entering the respective gas line.

In operation, the sluice vessel 2 is filled with a batch of coal 41. The batch of coal powder 41 is sufficient to fill a substantial part of the vessel, at least covering the inlet of CO2 line 39. Alternatively, the coal may also cover other inlets, for instance the inlet of line 7. Typically, the vessel 2 is filled above a predetermined threshold ensuring that the surface or top level 37 of the batch of coal 41 is well above the inlet of line 39. In a preferred embodiment, the threshold filling of the vessel 2 is at least 30% of the interior volume of the vessel or more. At threshold filling of 30% or more, the top surface 37 of the batch of coal 41 is at or above 30% of the height of the sluice vessel 2.

Subsequently, the vessel is pressurized up to a predetermined pressure, by introducing gas in the vessel. If recycled CO2 is used for the pressurization, the CO2 is introduced in the vessel 2 only via the inlets which are covered by the feedstock 41. In the embodiment of FIG. 2, CO2 may be introduced via lines 7 and 39 only. Preferably, all the recycled CO2 is introduced via the gas inlets submerged or covered by the feedstock 41.

The CO2 is introduced relatively slowly, to allow the CO2 ample time to contact the feedstock and allow the feedstock to obsorb as much of the methanol in the CO2 stream as possible. The flow rate of the CO2 stream into the vessel 2 and/or the time period for increasing the internal pressure in the vessel 2 from atmospheric pressure up to the selected second pressure level, can be selected depending on the (estimated or measured) amount of methanol in the recycled CO2. In a practical embodiment, the recycled CO2 may be introduced during a time period of at least several minutes, for instance at least 4 to 6 minutes.

The reduced CO2 flow rate may be significantly less, for instance about 0.5 times or less, than the regular influx of pressurizing gas. The CO2 flow rate may be at most 10 ft3 per minute (0.3 m3 per minute) for each pound (0.5 kg) of feedstock in the batch 41. The regular influx may be about 20 ft3 per minute (0.57 m3 per minute) of gas influx into the lockhopper 2.

Details of the operation and features of a suitable sluice vessel, are for instance provided in US-20090218411-A1. US-20090218411-A1 discloses a sluice vessel for feeding solid particulates into a pressurized pressure vessel, the sluice vessel having a low pressure state and a high pressure state, the sluice vessel comprising means for charging the sluice vessel with a load of the solid particulates when the sluice vessel is in its low pressure state, at least one discharge port, and pressurising means for increasing the pressure inside the vessel by bringing a pressurising fluid into the vessel, to bring the vessel into its high pressure state before discharging the load via the discharge port, whereby the pressurising means comprises one or more pressurising fluid inlet means arranged to be submerged under the load of solid particulates.

The recycled CO2 is introduced into the sluice vessel 2 using dedicated feeders at the bottom of the vessel. Herein, the recycled CO2 is forced to pass through the coal bed 41 in the vessel. The coal bed acts as a strong absorbent for methanol, thereby reducing the methanol concentration in the gas. The process can be designed such that the coal bed absorbtion is sufficient to reduce the methanol content to below a threshold level allowed for venting. For instance, the level of the coal bed and the flow speed of the stream of recycled CO2 relative to the coal bed can be optimized to maximize methanol absorbtion.

The present disclosure allows to reduce the methanol content in the recycled CO2 without any additional equipment, simply by changing the position of the CO2 feed into the sluice vessel 2. Herein, the CO2 is introduced in the sluice vessel via one or more inlets at the lower end of the vessel 2. Thus, the CO2 feed for pressurizing the sluice vessel is forced through the coal in a continuous manner, wherein the naturally strong absorption characteristics and capability of a finely milled coal powder are used to absorb the methanol.

Figure 3:
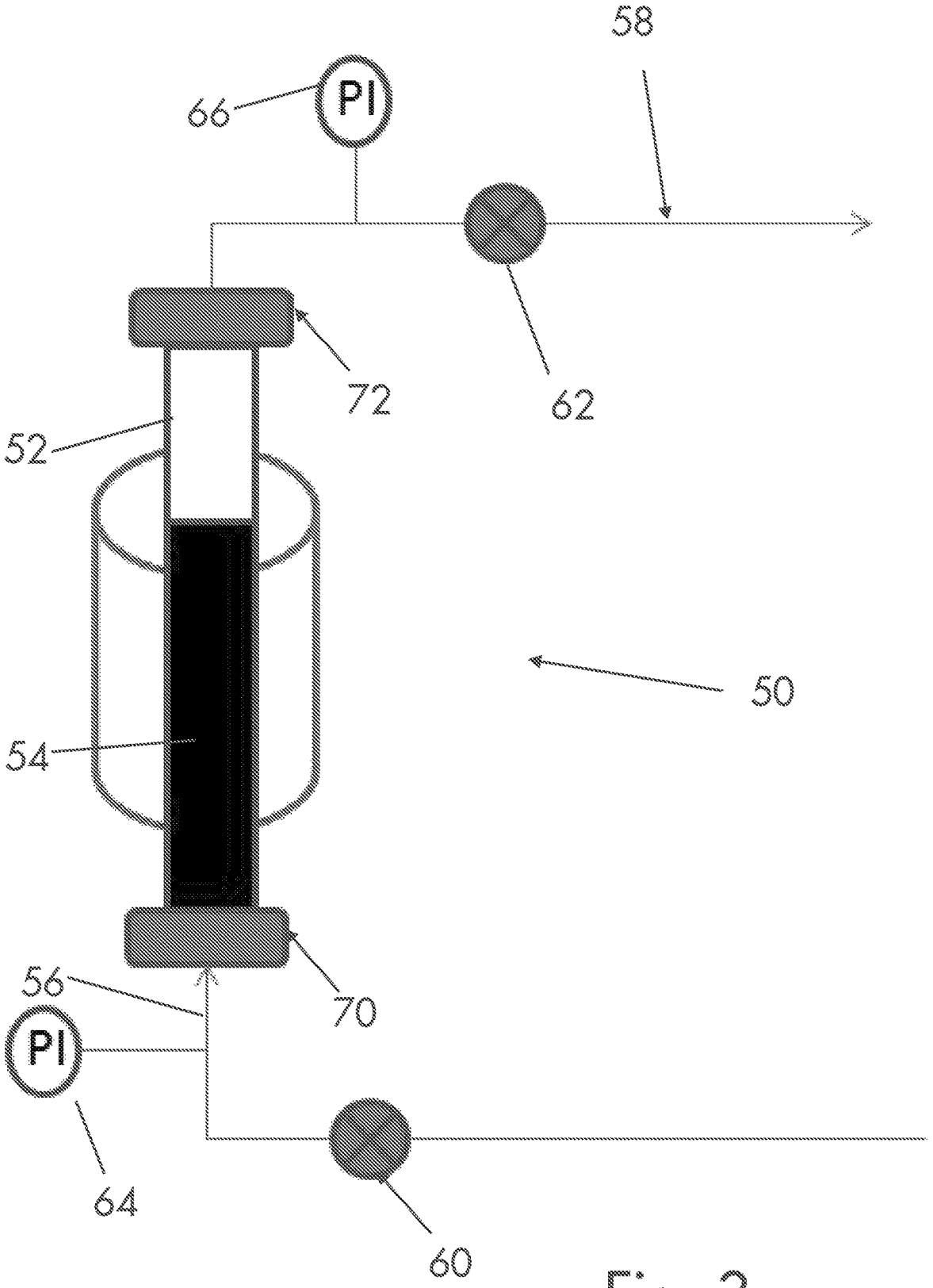
FIG. 3 shows a test setup for testing vent gas.

Tests have indicated parameters to optimize the process of the disclosure for methanol removal. FIG. 3 shows a test setup 50, comprising a test tube 52 filled with coal powder 54. The tube 52 is provided with a gas inlet conduit 56 and a vent conduit 58. The inlet and outlet conduits are provided with respective valves 60, 62 and/or pressure indicators 64, 66. The inlet and/or outlet conduit may communicate with the internals of the tube 52 via an appropriate filters 70, 72 respectively. The filters 70, 72 may allow gas to pass, while blocking the passage of coal powder. The filters may be made of ceramic material, or may comprise cotton and mesh, for instance.

Tests using the setup 50 of FIG. 3 have indicated an optimal sequence for the coal sluice vessel 2. The test sequence is:

1. introduce the coal 54 into the tube;
2. arrange filters 70, 72 at the inlet and outlet;
3. seal the tube 52;
4. vacuum the tube by venting and removing gas via vent conduit 58;
5. heat the walls of the tube 52, for instance by heat exchange with warm water, up to 90 degree C.;
6. introduce purge gas into the tube 52 via the inlet conduit 56. Gas is introduced until the pressure in the tube is 48 bar. This takes about 5 minutes;
7. close the valve 60;
8. keep the tube and the coal 54 at 90 degrees C. and 48 bar for about 10 minutes;
9. open the outlet valve 62 and release the gas in about 10 minutes;
10. use on-line gas chromatography (GC) to analyse methanol concentration;
11. Repeat the procedure several times.

In operation of the system (see also FIG. 1), the powder coal is charged from a powder coal storage vessel (not shown) into the sluice vessel 2 via a coal inlet port (not shown) while the sluice vessel 2 is at atmospheric pressure. The sluice vessel 2 is filled with coal powder for about 25% to 60% of its internal volume.

The sluice vessel 2 is closed, and pressurised by injecting recycled CO2 from line 27 into the sluice vessel 2 via submerged gas inlets 7, 39 only. The CO2 is introduced relatively slowly, taking several minutes to pressurize the vessel, to allow the CO2 to contact the coal. This may take about 4 to 10 minutes. The vessel is pressurized to about 40 to 60 bar.

After the pressure in the sluice vessel 2 is essentially equal to, or higher than the pressure in the feed hopper 6, the load of powder coal 41 is charged into the feed hopper 6 by opening outlet 4. This way, batches are pressurised and added to a buffer load of the powder coal in the feed hopper 6 to enable a continuous feed flow of powder coal from the hopper into the reactor 10 at operating pressure.

The feed hopper 6 may be provided with an aeration device in its cone-shaped floor, for establishing and maintaining a uniform mass flow rate of the coal particulates and gas mixture to the reactor 10. Examples of suitable aeration devices are disclosed in U.S. Pat. Nos. 4,943,190 and 4,934,876 and EP-A 0 308 024 which are incorporated by reference. In this form of aeration, a gaseous fluid is introduced in the feed hopper in or close to the cone-shaped floor. The gaseous fluid may be recycled CO2 via line 32, which is allowed to escape from the vessel together with the solid particulates to the reactor 10. Line 32 thus may not influence the pressure in the vessel 6.

Like the sluice vessel 2, the feed hopper 6 may additionally be provided with a venting outlet (not shown) for venting gas from the upper end of the feed hopper 6, for the purpose of maintaining an upward flow of gas from the aeration device through the particulates in the feed hopper 6.

An exemplary batch process according to the present disclosure to limit methanol venting when using recycled CO2 to pressurize the sluice vessel 2 may include the following steps:

1: introduce the coal 41 into the sluice vessel 2 via a coal inlet (not shown);
2. Close the coal inlet;
3. Optionally, heat the walls of the sluice vessel 2, for instance by heat exchange with warm water (heat exchange tubes not shown), for instance up to 90 degree C.;
4. Introduce recycled CO2 into the sluice vessel via one or more of inlets 7, 39 covered by the coal powder 41, to pressurize the vessel. CO2 gas is introduced during several minutes, until the pressure in the vessel exceeds a threshold, for instance 40 to 50 bar;
5. Close the gas inlet valve 60 of the vessel;
6. Keep the vessel and the coal 41 at the elevated temperature and pressure for at least a second time period. This may take several minutes, for instance about 10 to 20 minutes;
7. Open the coal outlet 4 of the sluice vessel 2 to supply the coal 41 to the feed hopper 6, when the feed hopper 6 requires an additional batch of coal;
8. Close the outlet 4; and
9. Repeat from step 1.

In a practical embodiment, the bulk density of the coal powder 41 may be about 0.5 g/cm3. Vcoal/Vempty=1:1.6, Vcoal/Vsluicevessel=1:2.6. Herein: Vcoal is the volume of the batch of feedstock 41 in the sluice vessel 2; Vempty is the volume of the empty section of the sluice vessel when the vessel 2 is filled with the batch of feedstock 41; and Vsluicevessel is the internal volume of the entire sluice vessel 2. The latter indicates the ratio of the volume of the coal batch with respect to the volume of the sluice vessel. Filling volume of the batch of coal 41 may be in the range of 30% to 55%, for instance 35% to 40% of the internal volume of the sluice vessel 2. Elevated temperature and pressure in the sluice vessel may be, for instance, about 90 degrees C. and/or about 48 bar.

The disclosure provides a simple yet effective process to limit the amount of methanol in recycled CO2. The process obviates expensive additional equipment, and is therefore cost effective, while allowing the gasification process to adhere to regulation for venting excess gas.

The present disclosure is not limited to the embodiments as described above, wherein many modifications are conceivable within the scope of the appended claims. Features of respective embodiments may for instance be combined.

The invention claimed is:

1. A process for the gasification of a solid carbonaceous feed, the process comprising the steps of:

introducing a batch of the solid carbonaceous feed into a sluice vessel, while an internal pressure in the sluice vessel is at a first pressure;

introducing a $CO_2$-containing feedback gas comprising methanol into the sluice vessel via one or more gas inlets covered by the solid carbonaceous feed, to pressurize the sluice vessel from the first pressure to a second pressure exceeding the first pressure, during a predetermined time period;

closing the one or more gas inlets;

opening a feed outlet of the sluice vessel to supply the batch of the solid carbonaceous feed to a feed vessel for feeding the solid carbonaceous feed to a gasification reactor;

closing the feed outlet;

venting the sluice vessel to reduce the internal pressure to the first pressure; and repeating the process;

wherein the $CO_2$-containing feedback gas is introduced into the sluice vessel only via the one or more gas inlets which are covered by the solid carbonaceous feed, and at a flow rate which is at most 0.3 $m^3$ per minute for each 0.5 kg of solid carbonaceous feed in the batch.

2. The process of claim 1, wherein the second pressure exceeds 40 bar.

3. The process of claim 1, wherein the predetermined time period for pressurizing the sluice vessel is at least 10 minutes.

4. The process of claim 1, wherein the $CO_2$-containing feedback gas is derived from a Rectisol syngas treating process which uses methanol as an absorbent.

5. The process of claim 4, wherein the $CO_2$-containing feedback gas comprises methanol in a concentration of at least 300 to 400 ppm (volume).

6. The process of claim 1, comprising a step of heating the walls of the sluice vessel after the step of introducing a batch of the solid carbonaceous feed.

7. The process of claim 6, the step of heating the walls of the sluice vessel comprises heating by heat exchange with water.

8. The process of claim 6 wherein the step of heating the walls of the sluice vessel comprises heating the walls of the sluice vessel up to at least 90 degrees C.

9. The process of claim 8, comprising a step of keeping the sluice vessel at an elevated temperature of at least 90 degrees C. and the second pressure during a second time period.

10. The process of claim 9, wherein the second time period is at least 10 minutes.

* * * * *